US010005985B2

(12) United States Patent
Luneau et al.

(10) Patent No.: US 10,005,985 B2
(45) Date of Patent: Jun. 26, 2018

(54) COPOLYMERS CONTAINING SILOXANE GROUPS AS SOIL-RELEASING AGENTS

(71) Applicant: Henkel AG & Co. KGaA, Duesseldorf (DE)

(72) Inventors: Benoit Luneau, Ratingen (DE); Frank Janssen, Cologne (DE); Carolin Kruppa, Hilden (DE); Christian Umbreit, Neuss (DE); Christa Junkes, Duesseldorf (DE); Stefanie Juntermanns, Duesseldorf (DE); Sofia Mandikos, Duesseldorf (DE)

(73) Assignee: Henkel AG & Co. KGaA (DE)

( * ) Notice: Subject to any disclaimer, the term of this patent is extended or adjusted under 35 U.S.C. 154(b) by 0 days. days.

(21) Appl. No.: 15/165,220

(22) Filed: May 26, 2016

(65) Prior Publication Data

US 2016/0264913 A1 Sep. 15, 2016

Related U.S. Application Data

(63) Continuation of application No. PCT/EP2014/077129, filed on Dec. 10, 2014.

(30) Foreign Application Priority Data

Dec. 16, 2013 (DE) ..... 10 2013 226 005

(51) Int. Cl.
*C11D 3/00* (2006.01)
*C11D 3/37* (2006.01)
*C11D 11/00* (2006.01)

(52) U.S. Cl.
CPC ..... *C11D 3/0036* (2013.01); *C11D 3/373* (2013.01); *C11D 3/3757* (2013.01); *C11D 11/0017* (2013.01)

(58) Field of Classification Search
CPC .... C11D 3/373; C11D 3/3757; C11D 11/0017
See application file for complete search history.

(56) References Cited

U.S. PATENT DOCUMENTS

| | | | |
|---|---|---|---|
| 4,000,093 | A | 12/1976 | Nicol et al. |
| 4,136,038 | A | 1/1979 | Pracht et al. |
| 5,196,493 | A | 3/1993 | Gruber et al. |
| 2006/0154840 | A1 | 7/2006 | Yagi et al. |

FOREIGN PATENT DOCUMENTS

| | | | |
|---|---|---|---|
| EP | 0213729 | A1 | 3/1987 |
| EP | 0213730 | A1 | 3/1987 |
| EP | 1092757 | A1 | 4/2001 |
| GB | 1464427 | | 2/1977 |
| GB | 1473201 | | 5/1977 |
| GB | 1473202 | | 5/1977 |
| GB | 1473571 | | 5/1977 |
| WO | 00/24856 | A1 | 5/2000 |

OTHER PUBLICATIONS

Hwang et al, "Facile Fabrication of Transparent Superhydrophobic Surfaces by Spray Deposition", ACS Applied Materials & Interfaces, vol. 3, pp. 2179-2183, Jul. 5, 2011.*
PCT International Search Report (PCT/EP2014/077129) dated May. 3, 2015.
Hwang et al., "Facile Fabrication of Transparent Superhydrophobic Surfaces by Spray Deposition", ACS Applied Materials & Interfaces, vol. 3, pp. 2179-2183, 2011.

* cited by examiner

*Primary Examiner* — Brian P Mruk
(74) *Attorney, Agent, or Firm* — Thomas G. Krivulka

(57) ABSTRACT

Agents including siloxane group-containing copolymers to improve the cleaning performance of detergents during the laundering of textiles. The disclosure relates to the use of specific soil-release polymeric active substances to intensify the cleaning performance of detergents in the laundering of textiles, to detergents containing such soil-release active substances, and to the use of such soil-release active substances for forming a protective layer on textile fabrics.

2 Claims, No Drawings

COPOLYMERS CONTAINING SILOXANE GROUPS AS SOIL-RELEASING AGENTS

FIELD OF THE INVENTION

The present invention generally relates to the use of specific soil-release polymeric active substances to intensify the cleaning performance of detergents in the laundering of textiles, to detergents containing such soil-release active substances, and to the use of such soil-release active substances for forming a protective layer on textile fabrics.

BACKGROUND OF THE INVENTION

In addition to ingredients essential for the washing process, such as surfactants and builder materials, detergents generally contain further components that can be grouped together under the term of washing auxiliaries and thus comprise various groups of active substances, such as foam regulators, graying inhibitors, bleaching agents, bleach activators, and color transfer inhibitors. Such auxiliaries also include substances that impart soil-repellent properties to laundry fibers and that, if present during the laundering process, support the soil-release capability of the other detergent components. Such soil-release substances are often called "soil-release" active substances or "soil repellents" because of their ability to make the treated surface, for example, of the fiber, soil-repellent. Thus, for example, the soil-release action of methyl cellulose is known from U.S. Pat. No. 4,136,038. European patent application EP 0213729 discloses the reduced redeposition with the use of detergents containing a combination of soap and a nonionic surfactant with alkylhydroxyalkyl cellulose. Textile treatment agents, containing cationic surfactants and nonionic cellulose ethers with HLB values of 3.1 to 3.8, are known from European patent application EP 0213730. U.S. Pat. No. 4,000,093 discloses detergents containing 0.1% by weight to 3% by weight of alkyl cellulose, hydroxyalkyl cellulose, or alkylhydroxyalkyl cellulose, and 5% by weight to 50% by weight of surfactant, whereby the surfactant component consists substantially of $C_{10}$ to $C_{13}$ alkyl sulfate and has up to 5% by weight of $C_{14}$ alkyl sulfate and less than 5% by weight of alkyl sulfate with alkyl groups of $C_{15}$ and above.

Because of their chemical similarity to polyester fibers, soil-release active substances that are particularly effective for textiles made of said material are copolyesters that contain dicarboxylic acid units, such as terephthalic acid or sulfoisophthalic acid, alkylene glycol units such as ethylene glycol or propylene glycol, and polyalkylene glycol units such as polyethylene glycol. Soil-release copolyesters of the aforesaid type, as well as the use thereof in detergents, have been known for some time.

The polymers known from the prior art have the disadvantage that they possess only insufficient or no activity particularly in regard to textiles that are not, or at least not predominantly, made of polyester. Many of today's textiles consist of cotton or cotton-polyester blended fabrics, however, so that there is a need for soil-release active substances more effective for greasy stains on such textiles in particular.

It is known from ACS Appl. Mater. Interfaces, 2011, 3, 2179-2183 that superhydrophobic surfaces can be produced by spraying solutions of poly(SiMA-co-MMA) onto substrates.

It was found surprisingly that the aforementioned object can be achieved by the use of specific siloxane group-containing polymers.

Furthermore, other desirable features and characteristics of the present invention will become apparent from the subsequent detailed description of the invention and the appended claims, taken in conjunction with this background of the invention.

BRIEF SUMMARY OF THE INVENTION

Use of copolymers with the monomeric unit of the general formula I and the monomeric unit of the general formula II,

I

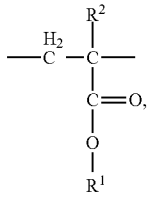

II

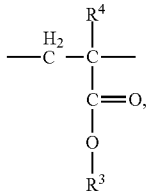

in which $R^1$ stands for $—(CH_2)_nSi(OSi(CH_3)_3)_m(OH)_p(R_5)_q$; $R^2$, $R^3$, and $R^4$ independently of one another for H or an alkyl group having 1 to 3 C atoms; $R^5$ for an alkyl group having 1 to 5 C atoms; n for a number from 1 to 3; and m, p, and q independently of one another for a number from 0 to 3, whereby the sum m+p+q=3, to intensify the cleaning performance of detergents in the laundering of textiles.

Use of copolymers with the monomeric unit of the general formula I and the monomeric unit of the general formula II,

I

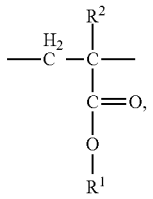

II

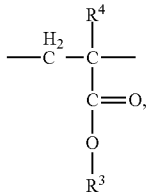

in which $R^1$ stands for $—(CH_2)_nSi(OSi(CH_3)_3)_m(OH)_p(R_5)_q$; $R^2$, $R^3$, and $R^4$ independently of one another for H or an alkyl group having 1 to 3 C atoms; $R^5$ for an alkyl group having 1 to 5 C atoms; n for a number from 1 to 3; and m, p, and q independently of one another for a number from 0 to 3, whereby the sum m+p+q=3, for intensification of the formation of a protective layer on textile fabrics.

A method for washing textiles in which a detergent and a copolymer with the monomeric unit of the general formula I and the monomeric unit of the general formula II,

I

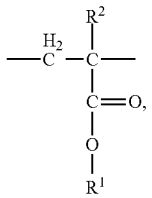

II

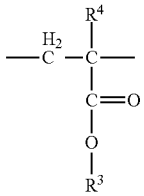

in which $R^1$ stands for $—(CH_2)_nSi(OSi(CH_3)_3)_m(OH)_p(R_5)_q$, $R^2$, $R^3$, and $R^4$ independently of one another for H or an alkyl group having 1 to 3 C atoms, $R^5$ for an alkyl group having 1 to 5 C atoms, n for a number from 1 to 3, and m, p, and q independently of one another for a number from 0 to 3, whereby the sum m+p+q=3, are used.

A detergent, containing a copolymer with the monomeric unit of the general formula I and the monomeric unit of the general formula II,

I

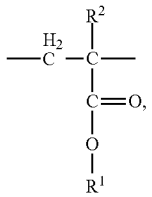

II

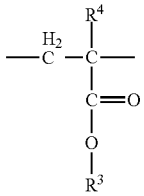

in which $R^1$ stands for $—(CH_2)_nSi(OSi(CH_3)_3)_m(OH)_p(R_5)_q$; $R^2$, $R^3$, and $R^4$ independently of one another for H or an alkyl group having 1 to 3 C atoms; $R^5$ for an alkyl group having 1 to 5 C atoms; n for a number from 1 to 3; and m, p, and q independently of one another for a number from 0 to 3, whereby the sum m+p+q=3.

A laundry aftertreatment agent, particularly a fabric softener, containing a copolymer with the monomeric unit of the general formula I and the monomeric unit of the general formula II,

I

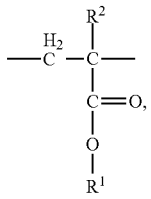

II

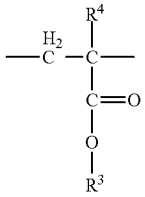

in which $R^1$ stands for $—(CH_2)_nSi(OSi(CH_3)_3)_m(OH)_p(R_5)_q$; $R^2$, $R^3$, and $R^4$ independently of one another for H or an alkyl group having 1 to 3 C atoms; $R^5$ for an alkyl group having 1 to 5 C atoms; n for a number from 1 to 3; and m, p, and q independently of one another for a number from 0 to 3, whereby the sum m+p+q=3.

DETAILED DESCRIPTION OF THE INVENTION

The following detailed description of the invention is merely exemplary in nature and is not intended to limit the invention or the application and uses of the invention. Furthermore, there is no intention to be bound by any theory presented in the preceding background of the invention or the following detailed description of the invention.

The subject matter of the invention is the use of copolymers with the monomeric unit of the general formula I and the monomeric unit of the general formula II,

I

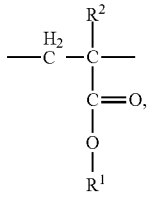

II

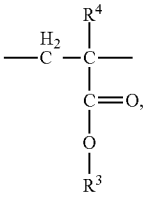

in which $R^1$ stands for $—(CH_2)_nSi(OSi(CH_3)_3)_m(OH)_p(R_5)_q$, $R^2$, $R^3$, and $R^4$ independently of one another for H or an alkyl group having 1 to 3 C atoms, $R^5$ for an alkyl group having 1 to 5 C atoms, n for a number from 1 to 3, and m, p, and q independently of one another for a number from 0 to 3, whereby the sum m+p+q=3, to intensify the cleaning performance of detergents in the laundering of textiles.

The aforementioned copolymers are obtainable by free-radical polymerization of ethylenically unsaturated precursors of the monomeric units of the general formulas I and II. They can contain the two monomeric units of the general formulas I and II in random distribution, or they have blocks I' and II' made up of the monomeric units I or II,

I'

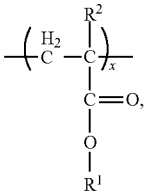

II'

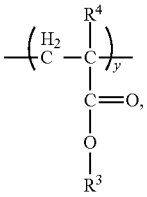

in which $R_1$, $R^2$, $R^3$, and $R^4$ have the aforesaid meaning and x and y independently of one another stand for numbers from 1 to 2000.

The siloxane group-containing copolymers can have, apart from the monomeric units I and II, if desired, other monomeric units derived from ethylenically unsaturated compounds. Preferably, they consist only of the monomeric units I and II, apart from portions originating from customary radical chain initiators and terminators.

In preferred copolymers, the molar ratio of monomeric unit I to monomeric unit II is in the range of 10:1 to 1:10, particularly of 3:1 to 1:3, and is particularly preferably 1:1. The average molar weight (here and below: the number average) is preferably in the range of 1000 g/mol to 5,000,000 g/mol, particularly of 2000 g/mol to 500,000 g/mol.

A further subject matter of the invention is the use of such siloxane group-containing copolymers for the formation of a protective layer on textile fabrics.

A further subject matter of the invention is a method for washing textiles in which method a detergent and a soil-release active substance are used in the form of the aforesaid siloxane group-containing copolymer. Said method can be carried out manually or optionally with the aid of a customary domestic washing machine. It is possible in this case to use the detergent and the soil-release active substance simultaneously or one after another. The simultaneous use can be carried out especially advantageously by the use of a detergent containing the soil-release active substance.

The effect of the active substance to be used according to the invention is especially pronounced in repeated use, in other words, particularly for the removal of stains from textiles that had already been washed in the presence of the active substance and/or were aftertreated before they were stained. It should be pointed out in connection with the aftertreatment that the indicated positive aspect can also be realized by a washing method in which the textile after the actual washing operation, performed with the aid of a detergent that can contain the aforesaid active substance, but in this case can also be free of it, is contacted with an aftertreatment agent, for example, as part of a fabric softening step, containing the active substance to be used according to the invention. In this approach as well, even if, if desired, once again a detergent without an active substance to be used according to the invention is used, the washing performance-enhancing effect of the active substances to be used according to the invention occurs in next washing operation. Said effect is much higher than an effect resulting from the use of a customary SRP active substance. In an especially preferred embodiment, in this case, the active substance essential to the invention is added in the fabric softening operation of the textile laundering.

The active substance used according to the invention results in a significantly better removal of particularly greasy and cosmetic stains on textiles, particularly those made of cotton or cotton-containing fabrics, than is the case when compounds known to date for this purpose are used. Alternatively, significant amounts of surfactants can be economized while the grease removal capability remains unchanged.

In the context of the laundering process, the use of the invention can occur such that the soil-release active substance is added to a detergent-containing bath or preferably the active substance is introduced as a component of a detergent into the bath, which contains the item to be cleaned or is brought into contact with it. A further subject matter of the invention therefore is a detergent that contains the aforesaid siloxane group-containing copolymer.

The use of the invention in the context of a laundry aftertreatment process can accordingly occur such that the soil-release active substance is added separately to the rinse water, which is used after the washing operation with use of a particularly bleach-containing detergent, or it is introduced as a component of the laundry aftertreatment agent, particularly a fabric softener. A further subject matter of the invention therefore is a laundry aftertreatment agent, particularly a fabric softener, containing the aforesaid siloxane group-containing copolymer. In this aspect of the invention, the detergent used before the laundry aftertreatment agent can also contain an active substance to be used according to the invention but can also be free of it.

The washing operation occurs preferably at a temperature of 15° C. to 60° C., particularly preferably at a temperature of 20° C. to 40° C. The washing operation occurs furthermore preferably at a pH of 6 to 11, particularly preferably at a pH of 7.5 to 9.5.

Agents that contain an active substance to be used according to the invention in the form of the siloxane group-containing copolymer or are used together with it or are used in the method of the invention, can contain all other customary components of such agents that do not interact in an undesirable fashion with the active substance of the invention, particularly a surfactant. Preferably, the active substance defined above is used in amounts of 0.01% by weight to 10% by weight, particularly preferably of 0.05% by weight to 4% by weight, and particularly of 0.2% by weight to 1% by weight, whereby these and the following quantitative data refer to the total agent, unless otherwise stated.

It was found surprisingly that the active substance used according to the invention positively influences the action of certain other detergent ingredients and that conversely the action of the soil-release active substance is additionally intensified by certain other detergent ingredients. These effects occur in particular with bleaching agents, enzymatic active substances, in particular proteases and lipases, water-soluble inorganic and/or organic builders, especially based on oxidized carbohydrates, or polymeric polycarboxylates, synthetic anionic surfactants of the sulfate and sulfonate type, and color transfer inhibitors, for example, vinylpyrrolidone, vinylpyridine, or vinylimidazole polymers or copolymers, or suitable polybetaines, for which reason the use of at least one of the aforesaid other ingredients together with the active substance to be used according to the invention is preferred.

An agent that contains an active substance to be used according to the invention or is used together with it or is used in the method of the invention contains preferably a peroxygen-based bleaching agent, particularly in amounts in the range of 5% by weight to 70% by weight, and optionally a bleach activator, particularly in amounts in the range of 2% by weight to 10% by weight, but in a further preferred embodiment can also be free of a bleaching agent and bleach activator. Possible bleaching agents are preferably the peroxygen compounds generally used in detergents such as percarboxylic acids, for example, dodecane diperacid or phthaloylaminoperoxicaproic acid, hydrogen peroxide, alkali perborate, which may be present as a tetrahydrate or monohydrate, percarbonate, perpyrophosphate, and persilicate, which are usually present as alkali salts, particularly as sodium salts. Bleaching agents of this kind are present in detergents, containing an active substance used according to the invention, preferably in amounts of up to 25% by weight, particularly of up to 15% by weight, and particularly preferably of 5% by weight to 15% by weight, based in each case on the total agent, percarbonate being used in particular. The optionally present bleach activator component comprises the usually employed N- or O-acyl compounds, for example, polyacylated alkylenediamines, particularly tetraacetylethylenediamine, acylated glycolurils, particularly tetraacetylglycoluril, N-acylated hydantoins, hydrazides, triazoles, urazoles, diketopiperazines, sulfurylamides, and cyanurates, in addition carboxylic anhydrides, particularly phthalic anhydride, carboxylic acid esters, particularly sodium isononanoyl phenolsulfonate, and acylated sugar derivatives, particularly pentaacetyl glucose, and cationic nitrile derivatives such as trimethylammonium acetonitrile salts. In order to prevent interaction with the per-compounds during storage, the bleach activators can be coated with coating substances or granulated in known fashion, whereby tetraacetylethylenediamine granulated with the aid of carboxymethylcellulose and with weight average particle sizes of 0.01 mm to 0.8 mm, granulated 1,5-diacetyl-2,4-dioxohexahydro-1,3,5-triazine, and/or trialkylammonium acetonitrile produced in particle form are particularly preferred. Detergents contain bleach activators of this kind preferably in amounts of up to 8% by weight, particularly of 2% by weight to 6% by weight, based in each case on the total agent.

In a preferred embodiment, an agent of the invention, used according to the invention or used in the method of the invention, contains a nonionic surfactant selected from fatty alkyl polyglycosides, fatty alkyl polyalkoxylates, in particular ethoxylates and/or propoxylates, fatty acid polyhydroxyamides, and/or ethoxylation and/or propoxylation products of fatty alkylamines, vicinal diols, fatty acid alkyl esters, and/or fatty acid amides, and mixtures thereof, particularly in an amount in the range of 2% by weight to 25% by weight.

A further embodiment of such agents comprises the presence of a synthetic anionic surfactant of the sulfate and/or sulfonate type, particularly fatty alkyl sulfate, fatty alkyl ether sulfate, sulfo fatty acid esters, and/or sulfo fatty acid disalts, particularly in an amount in the range of 2% by weight to 25% by weight. The anionic surfactant is preferably selected from the alkyl or alkenyl sulfates and/or alkyl or alkenyl ether sulfates, in which the alkyl or alkenyl group has 8 to 22, particularly 12 to 18 C atoms. These are typically not individual substances but cuts or mixtures. Among these, those are preferred whose proportion of compounds with longer-chain groups in the range of 16 to 18 C atoms is above 20% by weight.

Possible nonionic surfactants include the alkoxylates, in particular the ethoxylates and/or propoxylates, of saturated or mono- to polyunsaturated linear or branched-chain alcohols having 10 to 22 C atoms, preferably 12 to 18 C atoms. The degree of alkoxylation of the alcohols in this case is usually between 1 and 20, preferably between 3 and 10. They can be prepared in known fashion by reacting the corresponding alcohols with the corresponding alkylene oxides. The derivatives of the fatty alcohols in particular are suitable, although their branched-chain isomers, in particular so-called oxo alcohols, may also be used for preparing usable alkoxylates. Accordingly, the alkoxylates, in particular the ethoxylates, of primary alcohols having linear, in particular dodecyl, tetradecyl, hexadecyl, or octadecyl groups and mixtures thereof are usable. In addition, appropriate alkoxylation products of alkylamines, vicinal diols, and carboxylic acid amides which correspond to the aforesaid alcohols with regard to the alkyl portion are also usable. Moreover, the ethylene oxide and/or propylene oxide insertion products of fatty acid alkyl esters and fatty acid polyhydroxyamides are suitable. So-called alkyl polyglycosides suitable for incorporation into the agents of the invention are compounds of the general formula $(G)_n$-$OR^{12}$, in which $R^{12}$ denotes an alkyl or alkenyl group having 8 to 22 C atoms, G a glycose unit, and n a number between 1 and 10. The glycoside component $(G)_n$ refers to oligomers or polymers of naturally occurring aldose or ketose monomers, which include in particular glucose, mannose, fructose, galactose, talose, gulose, altrose, allose, idose, ribose, arabinose, xylose, and lyxose. The oligomers made up of such glycosidically linked monomers are characterized not only by the type but also by the number of sugars they contain, the so-called degree of oligomerization. The degree of oligomerization n as a variable to be determined analytically generally assumes fractional numerical values; it has values between 1 and 10, and for the preferably used glycosides, a value less than 1.5, in particular between 1.2 and 1.4. Glucose is a preferred monomeric unit because it is readily available. The alkyl or alkenyl portion $R^{12}$ of the glycosides preferably likewise comes from readily available derivatives of renewable raw materials, in particular from fatty alcohols, although the branched-chain isomers thereof, in particular so-called oxo alcohols, may also be used for preparing usable glycosides. In particular the primary alcohols having linear octyl, decyl, dodecyl, tetradecyl, hexadecyl, or octadecyl groups and mixtures thereof are therefore usable. Particularly preferred alkyl glycosides contain a coconut fatty alkyl group, i.e., mixtures with substantially $R^{12}$=dodecyl and $R^{12}$=tetradecyl.

The nonionic surfactant is present in agents that contain a soil-release active substance used according to the invention, are used according to the invention, or used in the process of the invention, preferably in amounts of 1% by weight to 30% by weight, particularly of 1% by weight to 25% by weight, whereby amounts in the top portion of this range are more likely to be found in liquid detergents and particulate detergents are preferably more likely to contain lower amounts of up to 5% by weight.

The agents can contain, instead or additionally, other surfactants, preferably synthetic anionic surfactants of the sulfate or sulfonate type, such as, for example, alkylbenzenesulfonates, in amounts of preferably not more than 20% by weight, particularly of 0.1% by weight to 18% by weight, based in each case on the total agent. Alkyl and/or alkenyl sulfates having 8 to 22 C atoms, which carry an alkali-, ammonium-, or alkyl-, or hydroxyalkyl-substituted ammonium ion as a countercation, can be mentioned as anionic surfactants especially suitable for use in such agents. Preferred are the derivatives of fatty alcohols having particularly 12 to 18 C atoms and the branched-chain analogues thereof, the so-called oxo alcohols. The alkyl and alkenyl sulfates can be prepared in known fashion by reacting the corresponding alcohol component with a typical sulfating reagent, particularly sulfur trioxide or chlorosulfonic acid, and subsequent neutralization with alkali-, ammonium-, or alkyl-, or hydroxyalkyl-substituted ammonium bases. The sulfate-type surfactants that can be used also include the sulfated alkoxylation products of the aforesaid alcohols, the so-called ether sulfates. Such ether sulfates preferably contain 2 to 30, in particular 4 to 10 ethylene glycol groups per molecule. Suitable anionic surfactants of the sulfonate type include $\alpha$-sulfoesters which are obtainable by reaction of fatty acid esters with sulfur trioxide and subsequent neutralization, in particular the sulfonation products deriving from fatty acids having 8 to 22 C atoms, preferably 12 to 18 C atoms, and linear alcohols having 1 to 6 C atoms, preferably 1 to 4 C atoms, and the sulfo fatty acids resulting therefrom by formal saponification.

Soaps are appropriate as further optional surfactant-type ingredients, whereby saturated fatty acid soaps such as the salts of lauric acid, myristic acid, palmitic acid, or stearic acid, and soaps derived from natural fatty acid mixtures, for example, coconut, palm kernel, or tallow fatty acids are suitable. Preferred in particular are soap mixtures that are made up of 50% by weight to 100% by weight of saturated $C_{12}$-$C_{18}$ fatty acid soaps and 50% by weight of oleic acid soap. Soap is contained preferably in amounts of 0.1% by weight to 5% by weight. Liquid agents in particular that contain a polymer used according to the invention can however also contain higher soap amounts of generally up to 20% by weight.

If desired, the agents can also contain betaines and/or cationic surfactants, which, if present, are used preferably in amounts of 0.5% by weight to 7% by weight. Among these, the esterquats discussed below are particularly preferred.

In a further embodiment, the agent contains water-soluble and/or water-insoluble builders, selected in particular from alkali aluminosilicate, crystalline alkali silicate having a modulus greater than 1, monomeric polycarboxylate, polymeric polycarboxylate, and mixtures thereof, particularly in amounts in the range of 2.5% by weight to 60% by weight.

The agent contains preferably 20% by weight to 55% by weight of water-soluble and/or water-insoluble, organic and/or inorganic builders. Water-soluble organic builder substances include in particular those from the class of polycarboxylic acids, in particular citric acid and sugar acids, as well as polymeric (poly)carboxylic acids, in particular polycarboxylates obtainable by oxidation of polysaccharides, polymeric acrylic acids, methacrylic acids, maleic acids, and mixed polymers thereof, which can also contain, polymerized into them, small portions of polymerizable substances having no carboxylic acid functionality. The relative molecular mass of the homopolymers of unsaturated carboxylic acids is in general between 5000 g/mol and 200,000 g/mol, that of the copolymers between 2000 g/mol and 200,000 g/mol, preferably 50,000 g/mol to 120,000 g/mol, based on free acid. An especially preferred acrylic acid/maleic acid copolymer has a relative molecular mass of 50,000 g/mol to 100,000 g/mol. Suitable, albeit less preferred compounds of this class are copolymers of acrylic acid or methacrylic acid with vinyl ethers, such as vinyl methyl ethers, vinyl esters, ethylene, propylene, and styrene, the acid fraction of which amounts to at least 50% by weight. Terpolymers containing as monomers two carboxylic acids and/or the salts thereof and, as a third monomer, vinyl alcohol and/or a vinyl alcohol derivative or a carbohydrate may also be used as water-soluble organic builder substances. The first acid monomer or the salt thereof is derived from a monoethylenically unsaturated $C_3$-$C_8$ carboxylic acid and preferably from a $C_3$-$C_4$ monocarboxylic acid, in particular from (meth)acrylic acid. The second acid monomer or the salt thereof may be a derivative of a $C_4$-$C_8$ dicarboxylic acid, maleic acid being particularly preferred. The third monomeric unit in this case is formed by vinyl alcohol and/or preferably an esterified vinyl alcohol. Vinyl alcohol derivatives which represent an ester of short-chain carboxylic acids, for example, of $C_1$-$C_4$ carboxylic acids, with vinyl alcohol, are particularly preferred. Preferred terpolymers in this case contain 60% by weight to 95% by weight, particularly 70% by weight to 90% by weight of (meth)acrylic acid or (meth)acrylate, particularly preferably acrylic acid or acrylate, and maleic acid or maleate, and 5% by weight to 40% by weight, preferably 10% by weight to 30% by weight of vinyl alcohol and/or vinyl acetate. Very particularly preferred in this case are terpolymers in which the weight ratio of (meth)acrylic acid or (meth)acrylate to maleic acid or maleate is between 1:1 and 4:1, preferably between 2:1 and 3:1, and particularly 2:1 and 2.5:1. In this case, both the amounts and weight ratios are based on the acids. The second acid monomer or salt thereof can also be a derivative of an allylsulfonic acid, which is substituted in the 2-position with an alkyl group, preferably with a $C_1$-$C_4$ alkyl group, or an aromatic group, derived preferably from benzene or benzene derivatives. Preferred terpolymers in this case contain 40% by weight to 60% by weight, particularly 45 to 55% by weight of (meth)acrylic acid or (meth)acrylate, particularly preferably acrylic acid or acrylate, 10% by weight to 30% by weight, preferably 15% by weight to 25% by weight of methallylsulfonic acid or methallyl sulfonates, and as the third monomer 15% by weight to 40% by weight, preferably 20% by weight to 40% by weight of a carbohydrate. Said carbohydrate in this case can be, for example, a mono-, di-, oligo-, or polysaccharide, mono-, di-, or oligosaccharides being preferred and sucrose being particularly preferred. Predetermined breaking points, which are responsible for the good biodegradability of the polymer, are presumably incorporated into the polymer by the use of the third monomer. These terpolymers generally have a relative molecular mass between 1000 g/mol and 200,000 g/mol, preferably between 3000 g/mol and 10,000 g/mol. They can be used in the form of aqueous solutions, preferably in the form of 30 to 50% by weight aqueous solutions, particularly for the production of liquid agents. All the cited polycarboxylic acids are generally used in the form of their water-soluble salts, in particular their alkali salts.

Such organic builder substances are preferably contained in amounts of up to 40% by weight, in particular of up to 25% by weight, and particularly preferably of 1% by weight to 5% by weight. Amounts close to the cited upper limit are preferably used in paste-form or liquid, in particular aqueous, detergents.

Crystalline or amorphous alkali aluminosilicates in particular in amounts of up to 50% by weight, preferably not above 40% by weight, and in liquid agents particularly of 1% by weight to 5% by weight, are used as water-insoluble, water-dispersible inorganic builder materials. Among these, the crystalline aluminosilicates in detergent quality, particularly zeolite NaA and optionally NaX, are preferred. Amounts close to the cited upper limit are preferably used in solid, particulate agents. Suitable aluminosilicates have in particular no particles with a particle size of more than 30 mm and preferably consist of at least 80% by weight of particles with a size of less than 10 mm. The calcium binding capacity thereof, which may be determined according to the information in German patent document DE 2412837, is in the range of 100 to 200 mg of CaO per gram. Suitable substitutes or partial substitutes for the aforesaid aluminosilicate are crystalline alkali silicates, which may be present alone or in a mixture with amorphous silicates. Alkali silicates that can be used as builders in the agents preferably have a molar ratio of alkali oxide to $SiO_2$ of less than 0.95, particularly from 1:1.1 to 1:12 and can be amorphous or crystalline. Preferred alkali silicates are sodium silicates, particularly amorphous sodium silicates, with a molar ratio of $Na_2O:SiO_2$ of 1:2 to 1:2.8. Such amorphous alkali silicates are commercially available under the name Portil®, for example. They are preferably added as a solid and not in the form of a solution during the production. Crystalline phyllosilicates of the general formula $Na_2Si_xO_{2x+1}.yH_2O$, in which the so-called modulus x is a number from 1.9 to 4 and y is a number from 0 to 20, with preferred values for x being 2, 3, or 4, are preferably used as crystalline silicates, which can be present alone or in a mixture with amorphous silicates. Preferred crystalline phyllosilicates are those in which x assumes the values 2 or 3 in the cited general formula. Both β- and δ-sodium disilicates ($Na_2Si_2O_5.yH_2O$) are preferred in particular. Practically anhydrous crystalline alkali silicates of the aforesaid general formula, in which x denotes a number from 1.9 to 2.1, which silicates are prepared from amorphous alkali silicates, can also be used in agents containing an active substance to be used according to the invention. In a further preferred embodiment of the agents of the invention, a crystalline sodium phyllosilicate with a modulus of 2 to 3 is used, such as can be prepared from sand and soda. Crystalline sodium silicates having a modulus in the range of 1.9 to 3.5 are used in another preferred embodiment of detergents, containing an active substance used according to the invention. Their alkali silicate content is preferably 1% by weight to 50% by weight and particularly 5% by weight to 35% by weight, based on anhydrous active substance. If alkali aluminosilicate, particularly zeolite, is also present as an additional builder substance, the content of alkali silicate is preferably 1% by weight to 15% by weight and particularly 2% by weight to 8% by weight, based on anhydrous active substance. The weight ratio of aluminosilicate to silicate, based in each case on anhydrous active substances, is then preferably 4:1 to 10:1. In agents containing both amorphous and crystalline alkali silicates, the weight ratio of amorphous alkali silicate to crystalline alkali silicate is preferably 1:2 to 2:1 and particularly 1:1 to 2:1.

In addition to the aforesaid inorganic builders, other water-soluble or water-insoluble inorganic substances can be present in the agents that contain an active substance to be used according to the invention, can be used together with it, or be used in the method of the invention. Suitable in this connection are alkali carbonates, alkali hydrogen carbonates, and alkali sulfates and mixtures thereof. An additional inorganic material of this kind can be present in amounts of up to 70% by weight.

In addition, the agents may contain other components customary in detergents. These optional components include in particular enzymes, enzyme stabilizers, complexing agents for heavy metals, for example, aminopolycarboxylic acids, aminohydroxypolycarboxylic acids, polyphosphonic acids, and/or aminopolyphosphonic acids, foam inhibitors, for example, organopolysiloxanes or paraffins, solvents, and optical brighteners, for example, stilbenedisulfonic acid derivatives. Agents that contain an active substance used according to the invention preferably contain up to 1% by weight, particularly 0.01% by weight to 0.5% by weight of optical brighteners, in particular compounds from the class of substituted 4,4'-bis(2,4,6-triamino-s-triazinyl)stilbene-2,2'-disulfonic acids, up to 5% by weight, in particular 0.1% by weight to 2% by weight, of complexing agents for heavy metals, in particular aminoalkylene phosphonic acids and salts thereof, and up to 2% by weight, in particular 0.1% by weight to 1% by weight of foam inhibitors, whereby the aforesaid percentages by weight refer in each case to the total agent.

Solvents, which can be used in particular in liquid agents, are, apart from water, preferably those that are water-miscible. These include the lower alcohols, for example, ethanol, propanol, isopropanol, and the isomeric butanols, glycerol, lower glycols, for example, ethylene glycol and propylene glycol, and the ethers derivable from the aforesaid compound classes. Such liquid agents generally contain the active substances, used according to the invention, dissolved or in suspended form.

Optionally present enzymes are preferably selected from the group comprising protease, amylase, lipase, cellulase, hemicellulase, oxidase, peroxidase, or mixtures thereof. Suitable primarily is the protease obtained from microorganisms, such as bacteria or fungi. It can be obtained in known fashion by fermentation processes from suitable microorganisms. Proteases are commercially available, for example, under the names BLAP®, Savinase®, Esperase®, Maxatase®, Optimase®, Alcalase®, Durazym®, or Maxapem®. The usable lipases can be obtained, for example, from *Humicola lanuginosa*, from *Bacillus* species, from *Pseudomonas* species, from *Fusarium* species, from *Rhizopus* species, or from *Aspergillus* species. Suitable lipases are commercially available, for example, under the names Lipolase®, Lipozym®, Lipomax®, Lipex®, Amano® Lipase, Toyo-Jozo® Lipase, Meito® Lipase, and Diosynth® Lipase. Suitable amylases are commercially available, for example, under the names Maxamyl®, Termamyl®, Duramyl®, and Purafect® OxAm. The usable cellulases can be an enzyme which is obtainable from bacteria or fungi and has a pH optimum preferably in the weakly acidic to weakly alkaline range of 6 to 9.5. Such cellulases are commercially available under the names Celluzyme®, Carezyme®, and Ecostone®.

Customary enzyme stabilizers, optionally present especially in liquid agents, include amino alcohols, for example, mono-, di-, and triethanolamine and propanolamine and mixtures thereof, lower carboxylic acids, boric acid or alkali borates, boric acid/carboxylic acid combinations, boric acid esters, boronic acid derivatives, calcium salts, for example, a Ca/formic acid combination, magnesium salts, and/or sulfur-containing reducing agents.

Suitable foam inhibitors include long-chain soaps, in particular behenic soap, fatty acid amides, paraffins, waxes, microcrystalline waxes, organopolysiloxanes, and mixtures thereof, which may contain moreover microfine, optionally silanated or otherwise hydrophobized silicic acid. For use in particulate agents, such foam inhibitors are preferably bound to granular, water-soluble carrier substances.

In a preferred embodiment, an agent into which an active substance to be used according to invention is incorporated is particulate and contains up to 25% by weight, particularly 5% by weight to 20% by weight of bleaching agent, particularly alkali percarbonate, up to 15% by weight, particularly 1% by weight to 10% by weight of bleach activator, 20% by weight to 55% by weight of inorganic builder, up to 10% by weight, particularly 2% by weight to 8% by weight of water-soluble organic builder, 10% by weight to 25% by weight of synthetic anionic surfactant, 1% by weight to 5% by weight of nonionic surfactant, and up to 25% by weight, particularly 0.1% by weight to 25% by weight of inorganic salts, particularly alkali carbonate and/or alkali hydrogen carbonate.

In another preferred embodiment, an agent into which the active substance to be used according to the invention is incorporated is liquid and contains 1% by weight to 25% by weight, particularly 5% by weight to 15% by weight of nonionic surfactant, up to 10% by weight, particularly 0.5% by weight to 8% by weight of synthetic anionic surfactant, 3% by weight to 15% by weight, particularly 5% by weight to 10% by weight of soap, 0.5% by weight to 5% by weight, particularly 1% by weight to 4% by weight of organic builder, particularly polycarboxylate such as citrate, up to 1.5% by weight, particularly 0.1% by weight to 1% by weight of complexing agent for heavy metals, such as phosphonate, and, apart from optionally present enzyme, enzyme stabilizer, dye and/or scent, water and/or a water-miscible solvent.

It is also possible to use a combination of a soil-release active substance of the invention with a soil-release polymer of a dicarboxylic acid and an optionally polymeric diol to intensify the cleaning performance of detergents in the laundering of textiles. Such combinations with a particularly polyester-active soil-release polymer are also possible within the context of the agents of the invention and the method of the invention.

The known polyester-active soil-release polymers, which may be used in addition to the active substances essential to the invention, include copolyesters of dicarboxylic acids, for example, adipic acid, phthalic acid, or terephthalic acid, and diols, for example, ethylene glycol or propylene glycol, and polydiols, for example, polyethylene glycol or polypropylene glycol. The preferably used soil-release polyesters include compounds that are obtainable formally by esterification of two monomer parts, whereby the first monomer is a dicarboxylic acid HOOC-Ph-COOH, and the second monomer a diol HO—$(CHR_{11}—)_a$OH, which may also be present as a polymeric diol H—(O—$(CHR^{11}—)_a)_b$. Ph therein denotes an o-, m-, or p-phenylene group which may bear 1 to 4 substituents selected from alkyl groups having 1 to 22 C atoms, sulfonic acid groups, carboxyl groups, and mixtures thereof, $R^{11}$ denotes hydrogen, an alkyl group having 1 to 22 C atoms, and mixtures thereof, a denotes a number from 2 to 6, and b a number from 1 to 300. The polyesters obtainable therefrom preferably contain both monomeric diol units —O—$(CHR^{11}—)_a$O— and polymeric diol units —O—$(CHR^{11}—)_a)_b$O—. The molar ratio of monomeric diol units to polymeric diol units is preferably 100:1 to 1:100, particularly 10:1 to 1:10. The degree of polymerization b in the polymeric diol units is preferably in the range of 4 to 200, in particular 12 to 140. The molecular weight or the average molecular weight or the maximum of the molecular weight distribution of preferred soil-release polyesters is in the range of 250 g/mol to 100,000 g/mol, in particular 500 g/mol to 50,000 g/mol. The acid forming the basis for the Ph group is preferably selected from terephthalic acid, isophthalic acid, phthalic acid, trimellitic acid, mellitic acid, the isomers of sulfophthalic acid, sulfoisophthalic acid, and sulfoterephthalic acid, and mixtures thereof. Provided the acid groups thereof are not part of the ester bonds in the polymer, they are preferably present in the form of a salt, particularly an alkali or ammonium salt. Among these, the sodium and potassium salts are particularly preferred. If desired, instead of the HOOC-Ph-COOH monomer, small portions, in particular no more than 10 mol %, based on the content of Ph having the meaning stated above, of other acids which have at least two carboxyl groups may be contained in the soil-release polyester. These include, for example, alkylene and alkenylene dicarboxylic acids such as malonic acid, succinic acid, fumaric acid, maleic acid, glutaric acid, adipic acid, pimelic acid, suberic acid, azelaic acid, and sebacic acid. The preferred diols HO—$(CHR^{11}—)_a$OH include those in which $R^{11}$ is hydrogen and a is a number from 2 to 6, and those in which a has the value 2 and $R_{11}$ is selected from among hydrogen and alkyl groups having 1 to 10, in particular 1 to 3 C atoms. Of the last-mentioned diols, those of formula HO—$CH_2$—$CHR_{11}$—OH, in which $R_{11}$ has the aforesaid meaning, are particularly preferred. Examples of diol components are ethylene glycol, 1,2-propylene glycol, 1,3-propylene glycol, 1,4-butanediol, 1,5-pentanediol, 1,6-hexanediol, 1,8-octanediol, 1,2-decanediol, 1,2-dodecanediol, and neopentyl glycol. Among the polymeric diols, polyethylene glycol, having an average molar mass in the range of 1000 g/mol to 6000 g/mol, is particularly preferred.

If desired, these polyesters with the composition described above may also be end-capped, whereby alkyl groups having 1 to 22 C atoms and esters of monocarboxylic acids are suitable as end groups. The end groups bound via ester bonds can be based on alkyl, alkenyl, and aryl monocarboxylic acids having 5 to 32 C atoms, particularly 5 to 18 C atoms. These include valeric acid, caproic acid, enanthic acid, caprylic acid, pelargonic acid, capric acid, undecanoic acid, undecenoic acid, lauric acid, lauroleic acid, tridecanoic acid, myristic acid, myristoleic acid, pentadecanoic acid, palmitic acid, stearic acid, petroselic acid, petroselaidic acid, oleic acid, linoleic acid, linolaidic acid, linolenic acid, eleostearic acid, arachidic acid, gadoleic acid, arachidonic acid, behenic acid, erucic acid, brassidic acid, clupanodonic acid, lignoceric acid, cerotic acid, melissic acid, and benzoic acid, which can carry 1 to 5 substituents having a total of up to 25 C atoms, in particular, 1 to 12 C atoms, for example, tert-butylbenzoic acid. The end groups can also be based on hydroxymonocarboxylic acids having 5 to 22 C atoms, which include, for example, hydroxyvaleric acid, hydroxycaproic acid, ricinoleic acid, its hydrogenation product hydroxystearic acid, and o-, m-, and p-hydroxybenzoic acid. The hydroxymonocarboxylic acids can in turn be connected to one another via their hydroxyl group and their carboxyl group, and thus be present in multiple fashion in an end group. The number of hydroxymonocarboxylic acid units per end group, i.e., their degree of oligomerization, is preferably in the range of 1 to 50, in particular of 1 to 10. In a preferred embodiment of the invention, polymers of ethylene terephthalate and polyethylene oxide terephthalate, in which the polyethylene glycol units have molar weights from of 750 to 5000 and the molar ratio of ethylene terephthalate to polyethylene oxide terephthalate is 50:50 to 90:10, are used in combination with an active substance essential to the invention.

The polyester-active soil-release polymers are preferably water-soluble, whereby the term "water-soluble" is understood to mean a solubility of at least 0.01 g, preferably at least 0.1 g of the polymer per liter of water at room temperature and pH 8. Preferably employed polymers under these conditions, however, have a solubility of at least 1 g per liter, particularly at least 10 g per liter.

Preferred laundry aftertreatment agents, containing an active substance to be used according to the invention, have as a laundry-softening active substance a so-called esterquat, i.e., a quaternized ester of carboxylic acid and amino alcohol. These are known substances, which can be obtained according to relevant methods of preparative organic chemistry, for example, by partially esterifying triethanolamine with fatty acids in the presence of hypophosphorous acid, passing air through, and then quaternizing with dimethyl sulfate or ethylene oxide. The preparation of solid esterquats is also known, in which the quaternization of triethanolamine esters is carried out in the presence of suitable dispersing agents, preferably fatty alcohols.

Esterquats preferred in the agents are quaternized fatty acid triethanolamine ester salts that conform to the formula (IV), (IV)

$$[R^1CO-(OCH_2CH_2)_mOCH_2CH_2-\underset{\underset{CH_2CH_2O(CH_2CH_2O)_pR^3}{|}}{\overset{\overset{R^4}{|}}{N^+}}-CH_2CH_2O-(CH_2CH_2O)_nR^2]\ X^-,$$

in which $R^1CO$ stands for an acyl group having 6 to 22 carbon atoms, $R^2$ and $R^3$ independently of one another for hydrogen or $R^1CO$, $R^4$ for an alkyl group having 1 to 4 carbon atoms or a $(CH_2CH_2O)_qH$ group, m, n and p in total for 0 or for numbers from 1 to 12, q for numbers from 1 to 12, and X for a charge-compensating anion such as halide, alkyl sulfate, or alkyl phosphate.

Typical examples of esterquats, which may be used within the context of the invention, are products based on caproic acid, caprylic acid, capric acid, lauric acid, myristic acid, palmitic acid, isostearic acid, stearic acid, oleic acid, elaidic acid, arachidic acid, behenic acid, and erucic acid, and technical mixtures thereof, such as those that occur, for example, during high-pressure cleavage of natural fats and oils. Preferably, technical $C_{12/18}$ coconut fatty acids and particularly partially hydrogenated $C_{16/18}$ tallow or palm fatty acids and elaidic acid-rich $C_{16/18}$ fatty acid cuts are employed. To prepare the quaternized esters, the fatty acids and triethanolamine can be used generally in the molar ratio of 1.1:1 to 3:1. In terms of technical application properties of the esterquats, using a ratio of 1.2:1 to 2.2:1, preferably 1.5:1 to 1.9:1 has proven particularly advantageous. The preferably employed esterquats are technical mixtures of mono-, di-, and triesters with an average degree of esterification of 1.5 to 1.9 and are derived from technical $C_{16/18}$ tallow or palm fatty acid (iodine value 0 to 40). Quaternized fatty acid triethanolamine ester salts of the formula (IV), in which $R^1CO$ stands for an acyl group having 16 to 18 carbon atoms, $R^2$ for $R^1CO$, $R^3$ for hydrogen, $R^4$ for a methyl group, m, n and p for 0, and X for methyl sulfate, have proven particularly advantageous.

Apart from the quaternized carboxylic acid triethanolamine ester salts, suitable esterquats also include quaternized ester salts of carboxylic acids with diethanol alkylamines of the formula (V), (V)

$$[R^1CO-(OCH_2CH_2)_mOCH_2CH_2-\underset{\underset{R^5}{|}}{\overset{\overset{R^4}{|}}{N^+}}-CH_2CH_2O-(CH_2CH_2O)_nR^2]\ X^-,$$

in which $R^1CO$ stands for an acyl group having 6 to 22 carbon atoms, $R^2$ for hydrogen or $R^1CO$, $R^4$ and $R^5$ independently of one another for alkyl groups having 1 to 4 carbon atoms, m and n in total for 0 or for numbers from 1 to 12, and X for a charge-compensating anion such as halide, alkyl sulfate, or alkyl phosphate.

Lastly, the quaternized ester salts of carboxylic acids with 1,2-dihydroxypropyldialkylamines of the formula (VI) can be mentioned as another group of suitable esterquats, (VI)

$$[R^4-\underset{\underset{R^7}{|}}{\overset{\overset{R^6}{|}}{N^+}}-CH_2\overset{\overset{O-(CH_2CH_2O)_mOCR^1}{|}}{CH}CH_2O-(CH_2CH_2O)_nR^2]\ X^-,$$

in which $R^1CO$ stands for an acyl group having 6 to 22 carbon atoms, $R^2$ for hydrogen or $R^1CO$, $R^4$, $R^6$, and IC independently of one another for alkyl groups having 1 to 4 carbon atoms, m and n in total for 0 or for numbers from 1 to 12, and X for a charge-compensating anion such as halide, alkyl sulfate, or alkyl phosphate.

With respect to the selection of the preferred fatty acids and the optimal degree of esterification, the exemplary statements made for (IV) apply analogously also to the esterquats of the formulas (V) and (VI). The esterquats are usually marketed in the form of 50 to 90% by weight alcohol solutions, which can also be readily diluted with water, whereby ethanol, propanol, and isopropanol are the usual alcohol solvents.

Esterquats are preferably used in amounts of 5% by weight to 25% by weight, particularly 8% by weight to 20% by weight, based in each case on the total laundry aftertreatment agent. If desired, the laundry aftertreatment agents used according to the invention can contain in addition the aforesaid detergent ingredients, provided they do not interact negatively in an unacceptable manner with the esterquat. Preferably, this is a liquid, aqueous agent.

EXAMPLES

Example 1: Polymer Synthesis a) Polymer P1

4.05 g of methyl methacrylate, 17.44 g of 3-[tris(trimethylsiloxy)silyl]propyl methacrylate, 0.016 g of butanethiol, and 0.06 g of azobis(isobutyronitrile) were dissolved in 40 mL of toluene; the reaction solution was degassed in the ultrasonic bath for 20 minutes with the introduction of nitrogen, and then heated for 6 hours to 90° C.

Molar weight (Mw) of polymer P1: 95,000 g/mol b) Polymer P2

1.26 g of methyl methacrylate, 16.35 g of 3-[tris(trimethylsiloxy)silyl]propyl methacrylate, 0.046 g of butanethiol, and 0.17 g of azobis(isobutyronitrile) were dissolved in 40 mL of toluene; the reaction solution was degassed in the ultrasonic bath for 30 minutes with the introduction of nitrogen, and then heated for 6 hours to 90° C.

Molar weight (Mw) of polymer P2: 26,000 g/mol c) Polymer P3

5.09 g of methyl methacrylate, 21.79 g of 3-[tris(trimethylsiloxy)silyl]propyl methacrylate, 0.046 g of butanethiol, and 0.17 g of azobis(isobutyronitrile) were dissolved in 40 mL of toluene; the reaction solution was degassed in the ultrasonic bath for 20 minutes with the introduction of nitrogen, and then heated for 6 hours to 90° C.

Molar weight (Mw) of polymer P3: 15,500 g/mol d) Polymer P4

3.80 g of methyl methacrylate, 5.45 g of 3-[tris(trimethylsiloxy)silyl]propyl methacrylate, 0.05 g of butanethiol, and 0.17 g of azobis(isobutyronitrile) were dissolved in 40 mL of toluene; the reaction solution was degassed in the ultrasonic bath for 20 minutes with the introduction of nitrogen, and then heated for 6 hours to 90° C.

Molar weight (Mw) of P4: 11,000 g/mol e) Polymer P5

7.58 g of methyl methacrylate, 8.43 g of methacryloxymethylbis(trimethylsiloxy)methylsilane, 0.045 g of butanethiol, and 0.17 g of azobis(isobutyronitrile) were dissolved in 40 mL of toluene; the reaction solution was degassed in the ultrasonic bath for 20 minutes with the introduction of nitrogen, and then heated for 6 hours to 90° C.

Molar weight (Mw) of P5: 19,000 g/mol f) Polymer P6

5.99 g of methyl methacrylate, 8.59 g of 3-[tris(trimethylsiloxy)silyl]propyl methacrylate, and 0.06 g of azobis(isobutyronitrile) were dissolved in 50 mL of toluene; the reaction solution was degassed in the ultrasonic bath for 30 minutes with the introduction of nitrogen, and then heated for 24 hours to 70° C. 0.06 g of azobis(isobutyronitrile) was then metered in and the temperature was kept at 70° C. for another 6.5 hours.

Molar weight (Mw) of P6: 260,000 g/mol

The molar weight of polymers P1 to P6 was measured using GPC in THF (PMMA calibration).

Example 2

Detergent compositions M1 to M6 with one of the polymers P1 to P6 prepared in Example 1 and a polymer-free detergent V1 with the compositions given in Table 1 were used.

TABLE 1

Detergent composition (% by weight)

| | V1 | M1-M6 |
|---|---|---|
| $C_{12-14}$ fatty alcohol-7-ethylene oxide | 7 | 7 |
| $C_{12-18}$ fatty acid Na salt | 10 | 10 |
| Boric acid | 4 | 4 |
| Citric acid | 2 | 2 |
| Propanediol | 6 | 6 |
| NaOH | 3 | 3 |
| Protease | 0.6 | 0.6 |
| Amylase | 0.1 | 0.1 |
| P1, P2, P3, P4, P5, or P6 | — | 1 |
| Water | Remainder to 100 | |

Clean textiles made of cotton were washed 3 times under following conditions:

Washing machine: Miele W 918 Novotronic®

Washing temperature: 40° C.

Bath volume: 17 L

Water hardness: 16° dH

Laundry load: 3.5 kg of clean laundry (pillows, jerseys, kitchen towels) including text textiles with 75 mL in each case of one these detergent compositions and air dried. After the third washing cycle, the textiles were stained with a standardized stain made up of potting soil and stored for 7 days at room temperature. They were then washed again under the aforesaid conditions with the same detergent and then allowed to dry. The remaining spot intensity was determined by means of a DATA-COLOR Spectra Flash SF500 remission spectrometer.

The differences between the obtained intensity values (ddl) before and after the washing of the stained textiles with the detergents of the invention and the values for the detergent V1 are given in the following table. The higher the value, the greater the brightening achieved by the active substance employed according to the invention.

TABLE 2

Washing results

| Agent | ddl |
|---|---|
| M1 | 13.9 |
| M2 | 8.3 |
| M3 | 12.9 |
| M4 | 10.2 |
| M5 | 12.4 |
| M6 | 13.7 |

The results show that an increase in the cleaning performance was achieved by using the siloxane-group containing copolymers in the detergent composition.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

What is claimed is:

1. A method for washing textiles in which a detergent and a copolymer with the monomeric unit of the general formula I and the monomeric unit of the general formula II,

I

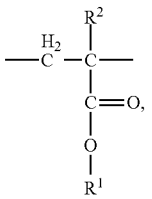

-continued

II

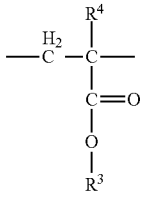

in which $R^1$ stands for $—(CH_2)_nSi(OSi(CH_3)_3)_m(OH)_p(R_5)_q$, $R^2$, $R^3$, and $R^4$ independently of one another for H or an alkyl group having 1 to 3 C atoms, $R^5$ for an alkyl group having 1 to 5 C atoms, n for a number from 1 to 3, and m, p, and q independently of one another for a number from 0 to 3, whereby the sum m+p+q=3, contacts the textiles in a wash.

2. The method according to claim 1, characterized in that the concentration used of the copolymer in the wash bath is 0.05% by weight to 3% by weight.

* * * * *